US005461205A

United States Patent [19]

Schulman

[11] Patent Number: 5,461,205

[45] Date of Patent: Oct. 24, 1995

[54] ELECTRODE STEM FOR AXIAL MAGNETIC FIELD VACUUM INTERRUPTERS

[75] Inventor: Michael B. Schulman, Pittsburgh, Pa.

[73] Assignee: Eaton Corporation, Cleveland, Ohio

[21] Appl. No.: 206,367

[22] Filed: Mar. 7, 1994

[51] Int. Cl.[6] ..... H01H 33/66

[52] U.S. Cl. ..... 200/5 R

[58] Field of Search ..... 200/144 R, 147 R, 200/147 A, 147 B, 144 A, 144 B

[56] References Cited

U.S. PATENT DOCUMENTS

| | | | |
|---|---|---|---|
| 3,158,722 | 11/1964 | Porter | 200/147 |
| 3,825,789 | 7/1974 | Harris | 200/144 B |
| 3,946,179 | 9/1974 | Murano et al. | 200/144 B |
| 4,516,004 | 5/1985 | Bany et al. | 200/144 B |
| 4,871,888 | 6/1988 | Bestel | 200/144 B |
| 4,935,588 | 3/1987 | Hess et al. | 200/144 B |

OTHER PUBLICATIONS

The Vacuum Interrupter Contact, P. G. Slade, IEEE Trans. on Components, Hybrids, and Mfg. Tech., v. MHT-7, No. 1, pp. 25–32, Mar. 1984.

*Primary Examiner*—Kristine L. Kincaid
*Assistant Examiner*—Michael A. Friedhofer
*Attorney, Agent, or Firm*—Martin J. Moran

[57] ABSTRACT

An axial magnetic field vacuum interrupter includes electrode stems each having a member made of a highly conductive material, such as high conductivity copper. The conducting member has a plurality of angularly spaced, longitudinally extending slots that can be left open or filled with a material of lower conductivity. The member can by surrounded by an annulus of a lower conductivity material for added structural support. An axial core fabricated of a lower conductivity material can also be used. The slots and the lower conductivity materials reduce the production of eddy currents in the stems by the axial magnetic field, and thereby serve to reduce the phase delay between the field and the current and improve the quality of the field in the intercontact region.

23 Claims, 4 Drawing Sheets

ELECTRODE STEM FOR AXIAL MAGNETIC FIELD VACUUM INTERRUPTERS

BACKGROUND OF THE INVENTION

1. Field of the Invention

This invention relates to vacuum interrupters, and, more particularly, to the design of electrode stems for axial magnetic field vacuum interrupters.

2. Description of the Prior Art

Vacuum interrupters are typically used, for instance, to reliably interrupt medium to high voltage a.c. currents of several thousands of amperes or more. They generally include a vacuum envelope enclosing a pair of facing contact electrodes that are relatively movable between a closed circuit position and an open circuit position. Each contact is connected to a current carrying electrode stem extending outside the vacuum envelope. Surrounding the contacts within the envelope is a vapor condensing shield aligned concentrically with the contacts and the electrode stems.

When the contacts are moved apart from the closed circuit position to the open circuit position, arcing of the current between the contacts occurs before the current is interrupted. The arcing can seriously damage the contacts, reducing the useful life of an interrupter. Metal from the contacts that is vaporized by the arc condenses back onto the contacts and also on the vapor shield, protecting the insulating vacuum envelope from accumulating deposits of metal.

The designs of practical commercial high-current vacuum interrupters have evolved over the past 30 years into two main types of contact arrangements, discussed in an article, entitled: The Vacuum Interrupter Contact. P. G. Slade, *IEEE TRANS. ON COMPONENTS, HYBRIDS, AND MFG. TECH.*, V. MHT-7, No. 1, p. 25–32, March 1984, and included herein by reference. Each type of contact arrangement produces a magnetic field that helps to control the initially columnar arc and promote its transition to a diffuse mode. In a first type of contact arrangement, a magnetic field is impressed perpendicular to the arc column in a direction that forces the arc to move rapidly around the circular periphery of the contact surface. This can be accomplished using slotted-cup contacts or contacts having spiral-shaped arms, wherein the magnetic field is self generated by the a.c. current. In a second type of contact arrangement, an axial magnetic field is generated in the contact region that forces the high-current arc to rapidly become diffuse and continuously distributed within the contact gap.

The axial magnetic field for the latter type of vacuum interrupter is typically generated by field coils using the current in the interrupter. In a first type, internal structures, such as axial field coils typically assembled as parts of the arcing contacts, direct the currents so as to produce an axial magnetic field in the contact gap. In a second type, the current passes through a coil structure surrounding the exterior of the vacuum interrupter, and the axial magnetic field penetrates through the insulating wall of the device and into the gap region. In both cases, the axial magnetic field produced is proportional to the instantaneous current in the interrupter.

It is well known that the flow of sinusoidal current in the internal or external axial magnetic field coils induces eddy currents in the conducting structures within the axial magnetic field vacuum interrupters. These eddy currents are undesirable, since they act to reduce the magnitude of the axial magnetic field and increase its phase delay from the coil current. The prior art has concentrated on reducing eddy currents in the faces of the arcing contacts. For example, U.S. Pat. No. 3,946,179, to Murano, et al., described slotted designs for contacting face plates in axial magnetic field vacuum interrupters that would reduce the eddy currents in that part of the device. U.S. Pat. No. 4,935,588, to Hess, et al., described contacting face plates for axial magnetic field vacuum interrupters having slots filled with a material having a conductivity that is less than the conductivity of the major portion of the contacting face plate.

Eddy currents generated in the highly conductive electrode stems can have the deleterious effect of reducing the axial magnetic field in the contact gap and increasing its phase delay from the coil current. It is important to minimize the phase delay of the axial magnetic field so that the field will rise above a critical level for producing a diffuse arc for the greatest possible fraction of the current cycle. The eddy currents in the electrode stems also tend to heat the stems and thereby reduce their current carrying capacity.

SUMMARY OF THE INVENTION

According to the present invention, electrode stems for an axial magnetic field vacuum interrupter each include an elongated member made of an electrically conductive material, such as, for example, high conductivity copper, and a plurality of angularly spaced, slots extending into the member and extending along a significant fraction of the length of the stem in a longitudinal direction defined by a longitudinal, or central axis of the stem. The slots extend into the member from positions at an outer perimeter of the member to positions between the longitudinal axis of the stem and the outer perimeter of the member.

According to further aspects of the invention, the slots can extend radially into each member, or they can each extend into the member at an angle to a radius, such as parallel to a tangent of the stem. The slots can also extend to different depths into the member.

According to a further aspect of the invention, the slots can be filled with a material having a significantly lower conductivity than that of the member to add structural stability.

According to another aspect of the invention, the electrode stem can also include a longitudinally extending filler member, or core, substantially surrounded by the slotted, conducting member, wherein the core is fabricated of a material having a significantly lower conductivity than that of the member.

According to another aspect of the invention, the electrode stem can include an outer sheath made of a material having a conductivity significantly less than that of the member and substantially surrounding the member.

An object of this invention is to provide an axial magnetic field vacuum interrupter that more effectively interrupts high currents than prior art designs.

It is a further object of this invention to provide an axial magnetic field vacuum interrupter wherein the production of eddy currents in the electrode stems is reduced.

It is a further object of this invention to provide an axial magnetic field vacuum interrupter with electrode stems that allow for a more complete penetration of the axial magnetic field into the contact gap than do prior art designs.

It is a further object of this invention to provide an axial magnetic field vacuum interrupter wherein the phase delay between the axial magnetic field and the current through the vacuum is reduced from that of prior art designs.

These and other objects of the present invention will be more fully understood from the following description of the invention with reference to the illustrations appended hereto.

DETAILED DESCRIPTION OF THE INVENTION

Figure 1:
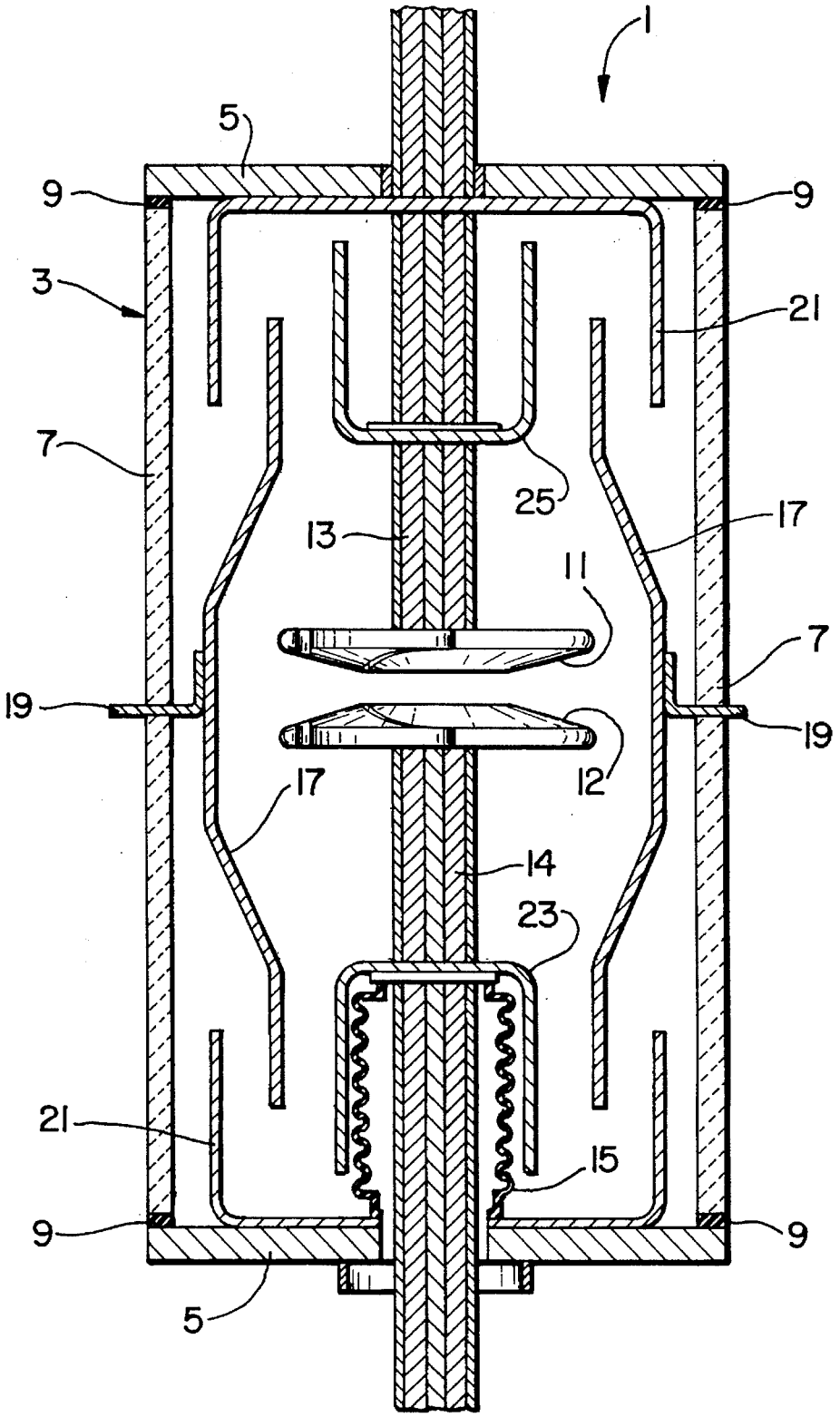
FIG. 1 is a longitudinal cross section of a vacuum interrupter incorporating electrode stems of this invention.

Referring now to the drawings, and in particular to FIG. 1, a vacuum interrupter 1 incorporating this invention is typically a generally cylindrical device. A vacuum envelope 3 enclosing the internal components includes spaced apart end caps 5 and a tubular, insulating casing 7 joined together by metal-to-insulation vacuum seals 9. The envelope 3 is evacuated to a pressure of about $10^{-6}$ Torr during use. Located within the envelope 3 are a pair of about disk-shaped electrical contacts 11, 12 shown here in their open circuit position. Each contact 11, 12 is connected to and supported by a corresponding, preferably cylindrical, conducting, electrode stem 13, 14 that provides electrical connection to an electric circuit (not shown) outside the interrupter 1. A bellows assembly 15 incorporated with a moveable one of the stems 14 allows the contacts 11, 12 to be relatively movable between a closed circuit position (not shown) wherein they are in contact and the open circuit position. Spaced apart from and surrounding the contacts 11, 12 is a generally cylindrical metal vapor condensing shield 17 for keeping metal deposits that may short out the interrupter from the inner surface of the insulating casing 7. The shield 17 can preferably be electrically isolated, i.e. floating, from both contacts 11, 12 as depicted in the drawing, or it can be electrically connected to one of the contacts. The vapor shield 17 is supported by a central support 19 connected to the insulating casing 7. End shields 21 protect the end caps 5 from accumulations of metals deposited by the metal vapors. Additional shields 23 and 25 are used to similarly protect the bellows assembly 15 and the fixed stem 13.

Figure 2:
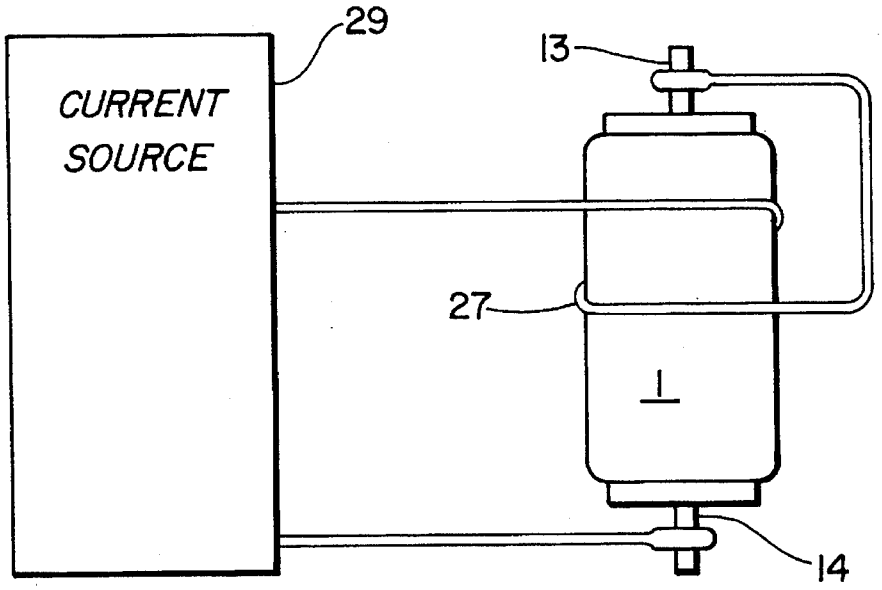
FIG. 2 is a schematic diagram of a vacuum interrupter, wherein an axial magnetic field is generated by an external coil.

A vacuum interrupter, such as that depicted in FIG. 1, can be modified to produce an axial magnetic field in the region of the contacts 11, 12 in order to more efficiently interrupt a high current in the circuit. Some axial magnetic field interrupters have an external coil 27 connected to the current source 29 (see FIG. 2). Others instead incorporate coil structures 31 and 32 into the contacts 11 and 12, respectively (see FIG. 3). Both the external coil and the internal coil structures generate a magnetic field with the current in the interrupter circuit. The reader is referred to the prior art articles and patents discussed above for examples of particular designs of the coil structure.

Figure 3:
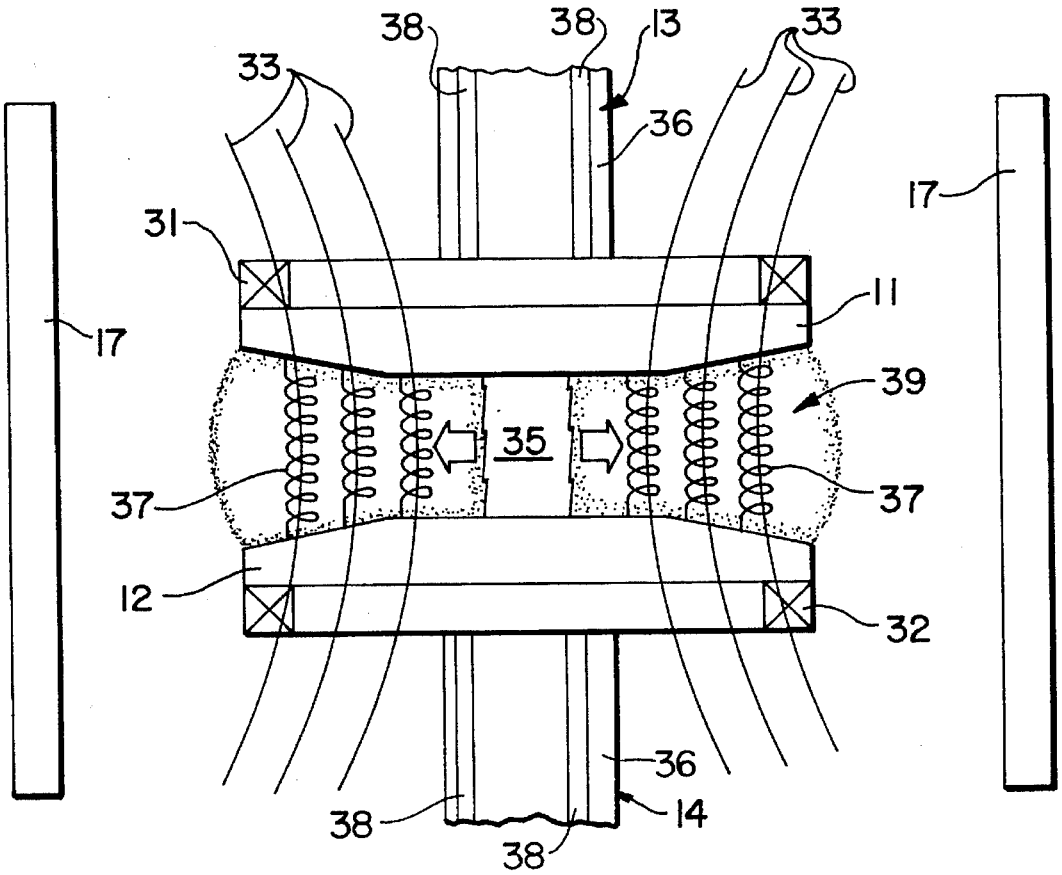
FIG. 3 is a schematic diagram of a portion of a vacuum interrupter wherein an axial magnetic field is generated by structures within the vacuum envelope.

As schematically depicted in FIG. 3, the coil structures 31 and 32 (or the external coil 27 of FIG. 2) produce an about axial magnetic field (shown by field lines 33) in the contact region. An arc column 35 forms between the contacts 11, 12, when they are first separated. Current carrying electrons move in tight spiral paths 37 along field lines 33 between the contacts 11, 12. Ions located between the contacts 11, 12, are attracted to the spiraling electrons, and this tends to rapidly spread cause the arc column to rapidly spread into a diffuse plasma 39 throughout the intercontact region, making the current more easily interruptable.

Eddy currents in the electrode stems can reduce the magnetic field in the contact region and also create a phase delay between the interrupter current and the field generated by the current, thus reducing the efficiency of the interrupter. According to the present invention, the stems 13, 14 each include an elongated, conducting member 36 that defines a plurality of circumferentially spaced slots 38, each slot 38 extending into the member 36 from an outer perimeter of the member 36 and extending in a longitudinal direction defined by a central axis of the electrode stem 36. The slots 38, by breaking up large diameter circular current paths in the stems 13, 14, reduce the eddy currents in the stems and thereby increase the efficiency of the interrupter.

Figure 4:
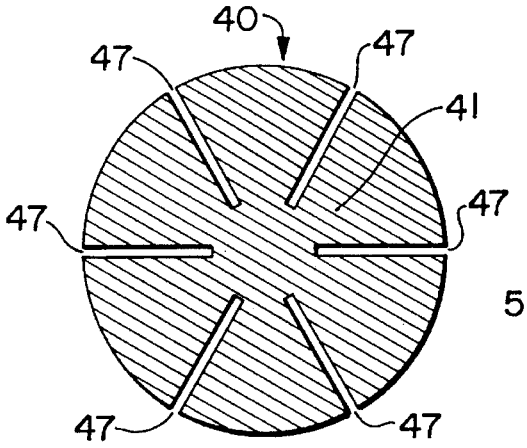
FIGS. 4–14 are radial cross sections of preferred embodiments of electrode stems of this invention.
Figure 5:
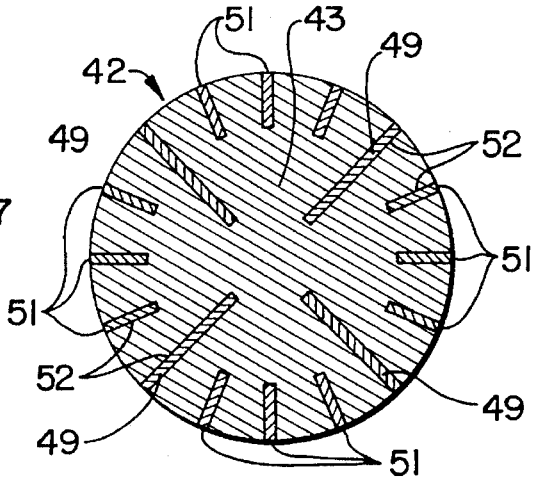
Figure 6:
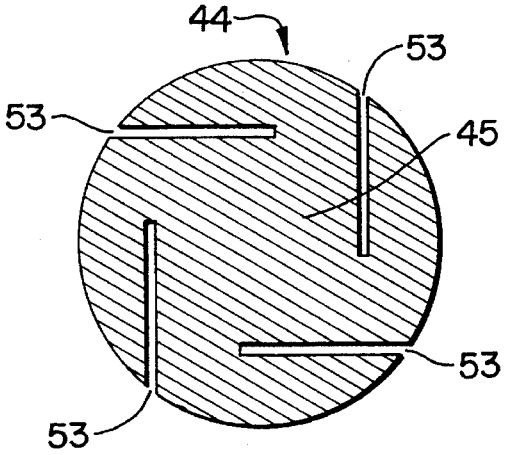

FIGS. 4–6 depict in radial cross section three different preferred designs for slotted electrode stems. Each of the stems 40, 42 and 44 includes a generally cylindrical, slotted member 41, 43, 45, respectively, fabricated from a material having a high electrical conductivity, such as OFHC copper, or a highly conducting composite material, such as a sintered copper-chromium metal mixture. The full diameter of a typical electrode stem ranges from 1 inch (2.54 cm) for a 1.5 inch (3.81 cm) diameter contact, to 1.5 inches (3.81 cm) for a 3.4 inch (8.63 cm) diameter contact. Future axial magnetic field interrupters for interrupting larger currents may use larger stems with diameters of about 2 inches (5.08 cm). The lengths of the stems in currently used interrupters typically range between about 2 inches (5.08 cm) and about 6 inches (15.24 cm).

Each member 41, 43, 45 has a plurality of angularly spaced slots extending in a longitudinal direction along the full length of the stem or at least a significant fraction of the length of the stem. The member 41 in FIG. 4 has radially extending, open slots 47 of even depth. The member 43 in FIG. 5 has radially extending slots 49 and 51 of two different depths. The member 45 has open slots 53 that each extend about parallel to a tangent of the stem. To retain structural stability, the maximum depth of an open slot is preferably no more than about a third the nominal diameter of the stem. In a stem having slots of different depths, such as slots 49 and 51 of member 43 in FIG. 5, the shorter, or minor, slots 51 are preferably about one half the depth of the deeper, or major, slots 49.

A reasonable minimum width for open slots is preferably about 0.0625 inches (0.159 cm). Larger widths, preferably no more than 0.125 inches (0.318 cm), can be used with stems having nominal diameters of 1.5 inches (3.81 cm) or more. Because of manufacturing considerations, the preferred slot widths will be determined by the thicknesses of standard circular saw blades.

To add structural stability, the slots can be filled with a filling material having a significantly lower conductivity than that of the member described above. For example, slots 49 and 51 in member 45 are illustrated filled in this manner with filling material 52. Preferred filling materials are non-magnetic and have high strength, such as 304 stainless steel. The added strength provided by the filling material would allow wider slots, up to as large as about twice the width of the corresponding open, unfilled slots. The slots can be filled by a variety of methods suitable for the filling material. For example, the slots in a stem member fabricated from OFHC copper could be filled with strips of sheet metal, such as stainless steel, of the same nominal width. The strips can be fixed in place by standard methods, such as soldering or brazing in a hydrogen oven. If the conducting members are made by powder metallurgical methods, such as a copper-chromium metal mixture, it is possible to provide the low conductivity filling during production as molded parts or as diffusion fillings. Suitable materials include iron, cobalt, nickel, titanium, aluminum, or alloys thereof. The reader is referred to U.S. Pat. No. 4,935,588, supra, for various methods of providing areas of low conductivity.

Figure 7:
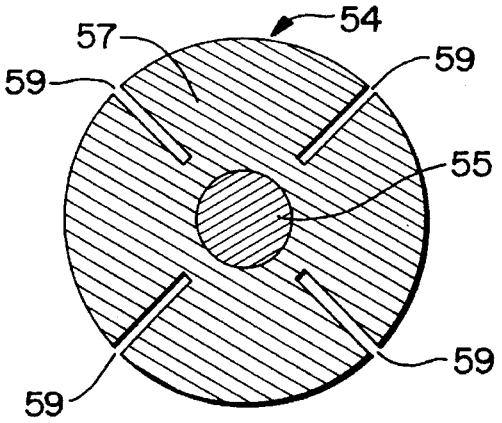
Figure 8:
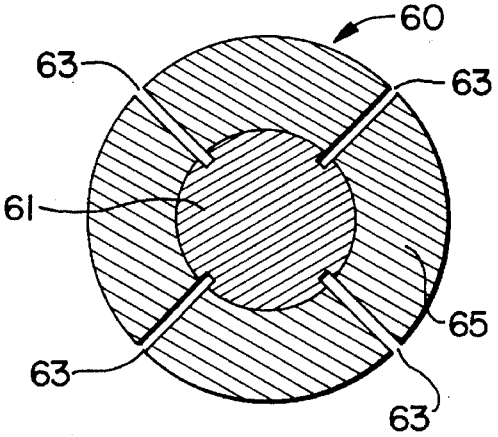
Figure 9:
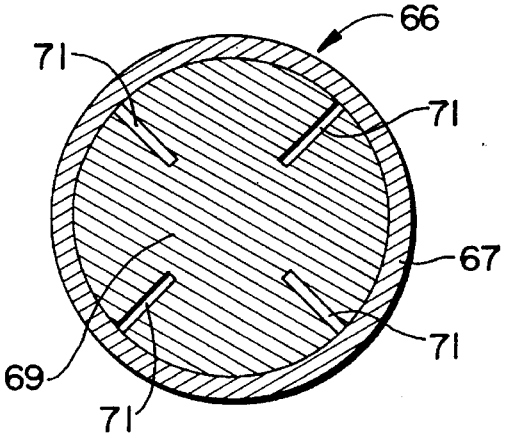
Figure 10:
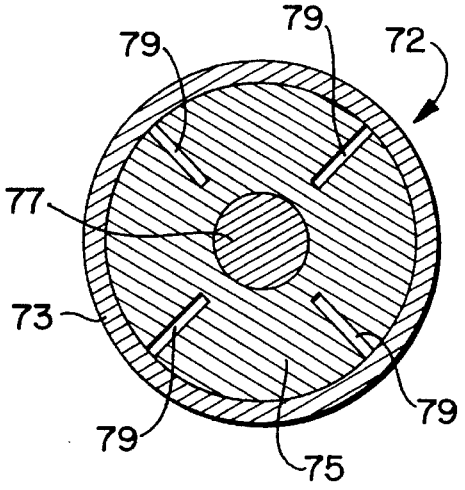
Figure 11:
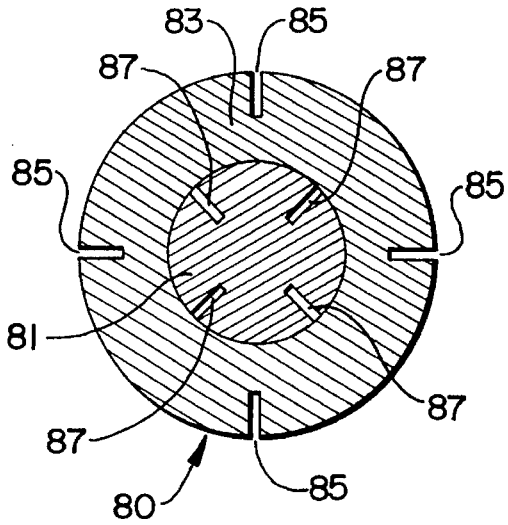
Figure 12:
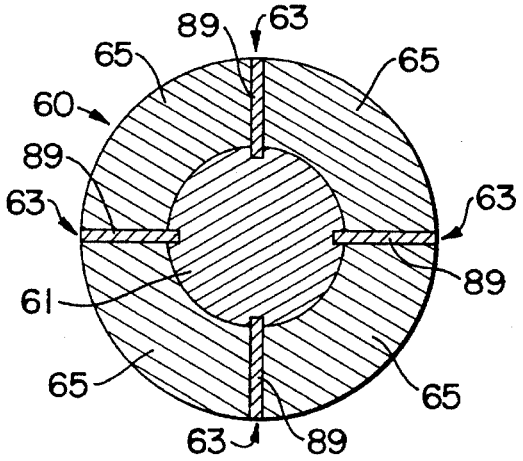
Figure 13:
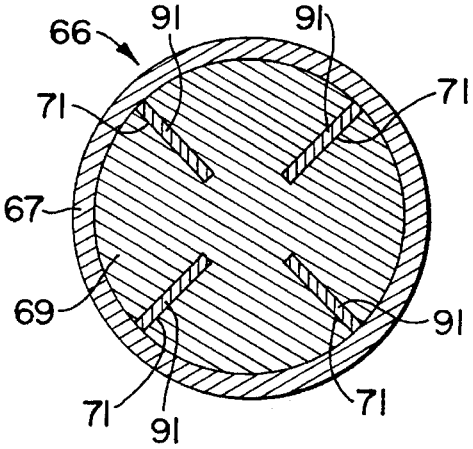
Figure 14:
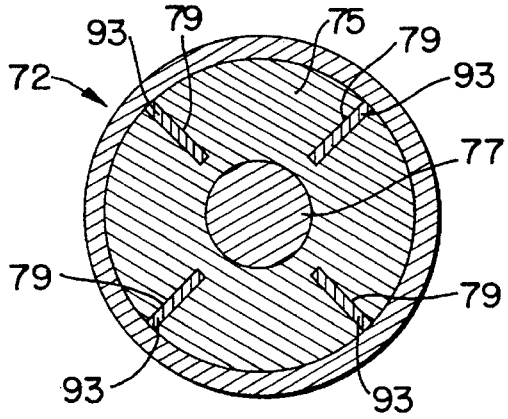

FIGS. 7–14 show radial cross sections of additional preferred electrode stem designs having central cores and/or sheaths of low conductivity material. FIG. 7 depicts a stem 54 having a central longitudinal core 55 that is fabricated of a material having a conductivity that is significantly less than that of a surrounding slotted, annular, conducting member 57. The open slots 59 extend radially into the annular member 57 only. FIG. 8 depicts a similar arrangement for a stem 60. However, in this case, the central core 61 of stem 60 has a larger radius than that of the central core 55 of the stem 54 depicted in FIG. 7. The slots 63 extend entirely through the conducting annular member 65 and partially into the central core 61. FIG. 12 illustrates stem 60 having slots 63 filled with a filler material 89 having a conductivity significantly lower than that of the conducting member 65, the filler material 89 providing structural strength to the stem 60. The stem 66 depicted in FIG. 9 includes an outer annulus 67, or sheath, surrounding a slotted, conducting member 69. The outer annulus 67 is fabricated of a material having a significantly lower conductivity than that of the conducting member 69. The slots 71 extend radially only into the conducting member 69. FIG. 13 illustrates stem 66, wherein slots 71 are filled with a filler material 91 having a conductivity significantly lower than that of the conducting member 69, the filler material 69 providing structural strength to the stem 66. FIG. 10 illustrates a stem 72 including an outer, low conductivity sheath 73 surrounding a slotted, annular, conducting member 75 that surrounds a low conductivity central core 77. The slots 79 extend radially into the conducting member 75 only. The electrode stems 13, 14 illustrated in FIG. 1 are similar to the design depicted in FIG. 10. FIG. 11 illustrates a stem 80 having a slotted, conducting member 81 for a central core, and a slotted outer annulus, or sheath 83, fabricated from a material having a significantly lower conductivity than that of the conducting member 81. The radially extending slots 85 in the sheath 83 are angularly offset from the radially extending slots 87 in the conducting member 81. FIG. 14 illustrates stem 72, wherein slots 79 are filled with a filler material 93 having a conductivity significantly lower than that of the conducting member 75, the filler material 93 providing structural strength to the stem 72.

Electrode stems incorporating low conductivity annuli and cores can be fabricated by soldering or brazing the different materials together. Standard size rod stock can be used for central cores and standard size tubing can be used for annuli for both the conducting members and the low conductivity materials. Slots that are surrounded by an annulus, such as in the embodiments shown in FIGS. 9–11, must be cut before placement of the annulus. Slots extending from the outer perimeter of the electrode stem, such as in the embodiments shown in FIGS. 7, 8 and 11, can be cut after assembly. The low conductivity materials are preferably stainless steel or one of the other low conductivity materials described above. As with the electrode stems 40, 42, 44 depicted in FIGS. 4–6, slots may be left open or filled with a low conductivity material, however, the stem designs having an outer annulus or sheath surrounding a conducting member provide substantial structural support even without filling the slots.

Slots can extend radially or at an angle from a radius, such as the slots of the embodiment illustrated in FIG. 6. The number of slots used in any stem is a design consideration based primarily on structural stability and current carrying capacity.

Whereas each of the exemplary preferred embodiments are generally cylindrical in shape, it is to be understood that an electrode stem of this invention can be fabricated in a variety of shapes having other than a generally circular cross section.

Computer simulations have shown that significant improvements in the density of magnetic flux lines in the contact gap and reduction of the phase delay of the field relative to a 60 Hz arcing current can be achieved by reduction of eddy currents in the stems. For example, calculations were performed for both high and low eddy current stems in model interrupters. Each model interrupter included a pair of 3 inch (7.6 cm) diameter butt-type contacts fabricated of a copper-chrome metal mixture (conductivity $1.9\times10^7$ Siemens/m), a ceramic vacuum envelope with a 5 inch (12.7 cm) external diameter, two external magnetic field coils of OFHC copper (conductivity $5.7\times10^7$ Siemens/m) having rectangular cross section, and bellows, end plates and shields made of stainless steel (conductivity $1.4\times10^6$ Siemens/m). The high eddy current stem interrupter included OFHC copper stems (conductivity $5.7\times10^7$ Siemens/m). The low eddy current stem interrupter was modeled with stems having a conductivity that was a factor of 100 less than the OFHC copper stems, which has the effect of significantly reducing the production of eddy currents in the stems. The calculations were performed for an interrupter arc current of 30 kA at 60 Hz.

For the copper stem interrupter, the axial field at the surface of the contacts ranged from 0.218 Tesla at the central axis to 0.341 Tesla at a step near the contact radial periphery. The phase delay from the coil current ranged from −64.1° at the central axis to −5.87° at the step. For the reduced eddy current stem interrupter, the axial field at the surface of the contacts ranged from 0.312 Tesla at the central axis to 0.350 Tesla at a step near the contact radial periphery, thereby showing dramatically increased strength and uniformity of field. The phase delay from the coil current was also improved throughout, having a range from −40.7° at the central axis to −4.69° at the step.

One skilled in the art may be able to make modifications and variations to the foregoing embodiments in addition to those described without departing from the true scope and spirit of the invention.

I claim:

1. An electrode stem for a vacuum interrupter, comprising an elongated conducting member having a plurality of spaced slots each extending into the member from an outer perimeter of the member and extending in a longitudinal direction defined by a central axis of the electrode stem.

2. The electrode stem of claim 1, wherein the member is fabricated of a material selected from the group consisting of copper, OFHC copper, a copper alloy, and a metal mixture containing copper.

3. The electrode stem of claim 2, wherein each of the slots is filled with a filler material having a conductivity that is significantly less than that of the member.

4. The electrode stem of claim 3, wherein each of the slots extends about radially into the member.

5. The electrode stem of claim 4, wherein at least two of the slots extend to different depths into the member.

6. The electrode stem of claim 3, wherein each of the slots extends into the member at an angle from a radius of the member.

7. The electrode stem of claim 1, wherein each of the slots extend about radially into the member.

8. The electrode stem of claim 7, wherein at least two of the slots extend to different depths into the member.

9. The electrode stem of claim 1, wherein each of the slots extends into the member at an angle from a radius of the member.

10. An electrode stem for a vacuum interrupter, comprising an elongated conducting member having a plurality of spaced slots each extending into the member from an outer perimeter of the member and extending in a longitudinal direction defined by a central axis of the electrode stem, and a sheath substantially surrounding the member and the slots, wherein the sheath is fabricated of a material having a conductivity that is significantly less than that of the member.

11. The electrode stem of claim 10, wherein the member is fabricated of a material selected from the group consisting of copper, OFHC copper, a copper alloy, and a metal mixture containing copper.

12. The electrode stem of claim 10, wherein each of the slots is filled with a filler material having a conductivity that is significantly less than that of the member.

13. The electrode stem of claim 10, wherein each of the slots extend about radially into the member.

14. The electrode stem of claim 13, wherein at least two of the slots extend to different depths into the member.

15. The electrode stem of claim 10, wherein each of the slots extends into the member at an angle from a radius of the member.

16. The electrode stem of claim 10, including a second plurality of spaced, longitudinally extending slots each extending from an outer perimeter of the stem into the sheath.

17. An electrode stem for a vacuum interrupter, comprising an elongated conducting member having a plurality of spaced slots each extending into the member from an outer perimeter of the member and extending in a longitudinal direction defined by a central axis of the electrode stem, and a core substantially surrounded by the member, wherein the core is fabricated of a material having a conductivity that is significantly less than that of the member.

18. The electrode stem of claim 17, wherein the member is fabricated of a material selected from the group consisting of copper, OFHC copper, a copper alloy, and a metal mixture containing copper.

19. The electrode stem of claim 17, wherein each of the slots is filled with a filler material having a conductivity that is significantly less than that of the member.

20. The electrode stem of claim 17, wherein each of the slots extends through the member and partially into the core.

21. An electrode stem for a vacuum interrupter, comprising an elongated core, a conducting member substantially surrounding the core and having a plurality of spaced slots each extending into the member from an outer perimeter of the member and extending in a longitudinal direction defined by a central axis of the electrode stem, and a sheath substantially surrounding the member and the core, wherein the sheath and the core have conductivities that are significantly lower than the conductivity of the member.

22. The electrode stem of claim 21, wherein the member is fabricated of a material selected from the group consisting of copper, OFHC copper, a copper alloy, and a metal mixture containing copper.

23. The electrode stem of claim 21, wherein each of the slots is filled with a filler material having a conductivity that is significantly less than that of the member.

* * * * *